US010058153B1

(12) United States Patent
Forero

(10) Patent No.: US 10,058,153 B1
(45) Date of Patent: Aug. 28, 2018

(54) SOLAR HEAT PROTECTIVE COVER

(71) Applicant: Maria Forero, Edison, NJ (US)

(72) Inventor: Maria Forero, Edison, NJ (US)

(73) Assignee: Maria Forero, Edison, NJ (US)

( * ) Notice: Subject to any disclaimer, the term of this patent is extended or adjusted under 35 U.S.C. 154(b) by 369 days.

(21) Appl. No.: 14/728,419

(22) Filed: Jun. 2, 2015

(51) Int. Cl.
*A45C 11/00* (2006.01)
*A45C 13/00* (2006.01)
*A45C 13/02* (2006.01)

(52) U.S. Cl.
CPC ..... *A45C 11/00* (2013.01); *A45C 13/005* (2013.01); *A45C 13/02* (2013.01); *A45C 2011/002* (2013.01); *A45C 2011/003* (2013.01); *A45C 2200/10* (2013.01)

(58) Field of Classification Search
CPC ..... A45C 11/00; A45C 2011/002; A45C 2011/003; A45C 13/02; A45C 13/005
USPC ..... 206/320
See application file for complete search history.

(56) References Cited

U.S. PATENT DOCUMENTS 5,048,734 A * 9/1991 Long ..... A45C 11/20 150/901
5,873,456 A * 2/1999 Hull ..... H01H 9/0242 206/305
6,286,667 B1 * 9/2001 Lee ..... G06F 15/02 206/305
6,772,881 B2 * 8/2004 Le ..... H01H 9/0242 150/165
7,663,879 B2 * 2/2010 Richardson ..... G06F 1/1613 206/320
7,668,309 B2 * 2/2010 Wilcox ..... B60R 11/0241 379/454
2006/0169607 A1 * 8/2006 Carnevali ..... G06F 1/1626 206/320
2006/0196792 A1 * 9/2006 Barth ..... B65D 31/02 206/320
2007/0215501 A1 * 9/2007 Hanson ..... B65D 81/02 206/320
2011/0011760 A1 * 1/2011 Habersetzer ..... G06F 1/1628 206/320
2011/0290676 A1 * 12/2011 Kershenstein ..... A45C 11/00 206/37
2012/0118769 A1 * 5/2012 Conner ..... A45C 11/00 206/320
2014/0001079 A1 * 1/2014 Green ..... A45C 13/02 206/577
2014/0224685 A1 * 8/2014 Carnevali ..... G06F 1/1626 206/320

* cited by examiner

*Primary Examiner* — Steven A. Reynolds
(74) *Attorney, Agent, or Firm* — Moser Taboada

(57) ABSTRACT

Provided among other things is a cover for a portable electronic device comprising: an exterior cover having at least one flexible connector and configured to enclose the electronic device, the cover having an open configuration and a closed configuration; wherein the cover comprises material having an exterior metalized surface and a foamed or bubbled interior layer, wherein the material is located to protect the electronic device from solar heat.

7 Claims, 4 Drawing Sheets

SOLAR HEAT PROTECTIVE COVER

The present application relates generally to covers for electronic devices that provide protection from solar heating.

Electronic devices are susceptible to shutting down or being damaged from too much heat. In many cases, the temperature in a room is temperate, but the electronic device sits in the sun and acquires a very substantial temperature from the electromagnetic radiation from the sun. Nonetheless, no one has recognized the importance of using a solar material such as described below to form the material for one or more of the major facets of an electronic device.

SUMMARY

Provided among other things is a cover for a portable electronic device comprising: an exterior cover having at least one flexible connector and configured to enclose the electronic device, the cover having an open configuration and a closed configuration; wherein the cover comprises material having an exterior metalized surface and a foamed or bubbled interior layer, wherein the material is located to protect the electronic device from solar heat.

DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only illustrative embodiments of this invention and are therefore not to be considered limiting of its scope, for the invention may admit to other equally effective embodiments.

Figure 1:
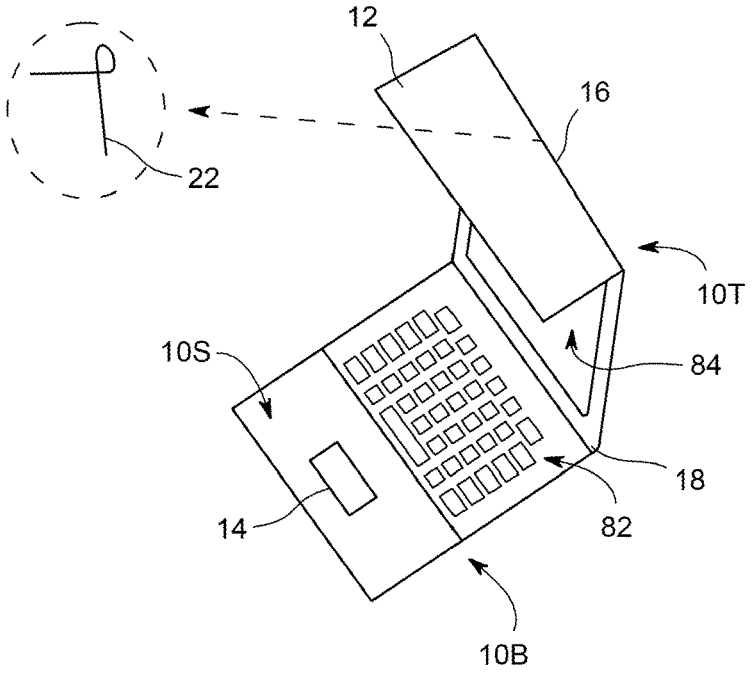
FIG. 1 depicts an illustrative cover as configured for a laptop computer.

To facilitate understanding, identical reference numerals have been used, where possible, to designate comparable elements that are common to the figures. The figures are not drawn to scale and may be simplified for clarity. It is contemplated that elements and features of one embodiment may be beneficially incorporated in other embodiments without further recitation.

DETAILED DESCRIPTION

FIG. 1 shows an illustrative electronic device cover 100 having a panel 10T that covers the back of the screen 84 of a laptop. Panel 10B covers the backside of the keyboard of a laptop. Panel 10S is the portion of a sleeve ES into which, if present, the laptop keyboard 82 fits. There can be open area 14 that allows for example a touch pad to be used. Panels 10T and 10B are linked by one or more connectors or hinges 18. Hinges 18 can be a portion of the material of panels 10T and 10B with a pre-fold, or can be another material, such as a more flexible material. Panels 10T and 10B are typically formed of a solar material. Solar material is positioned such that the chance that the electronic device overheats when placed in sun light is reduced.

Optional shade 12 can connected to the rest of the cover 100 by hinge 16. Sewn or embedded into the cover 100 at hinge 16 can be one or more springs 22 (see inset in FIG. 1). The springs act to bias the shade 12 to an appropriate angle for shading the screen 84. When the laptop is folded, the shade 12 can be folded for example between the screen 84 and keyboard 82. When the keyboard is opened, the shade 12 can be unfolded, for example with the assist of springs 22.

Figure 2:
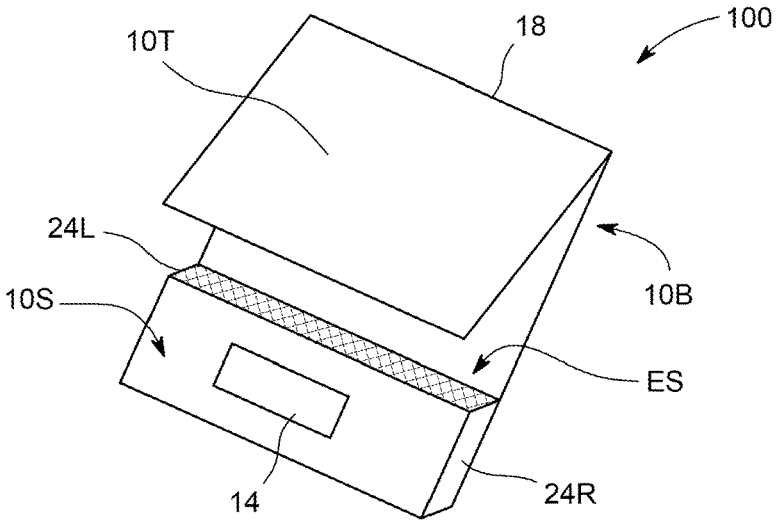
FIG. 2 depicts an illustrative cover as configured for a laptop computer.

FIG. 2 is a highly conceptual depiction of the cover 100 (with no shade shown). The drawing is highly conceptual for example because panel 10T is too short. The optional sleeve ES defines a slot into which the bottom of the keyboard 82 fits. The sides 24R and 24L can be a full covering of a material (such as a solar material), or can be a one or more strips of material, allowing access to any lateral ports to the laptop located in the lower part of the keyboard. Typically, no lateral material is used on upper parts of the keyboard to allow access to such lateral ports for electronic devices or connections.

In the absence of a sleeve ES, the electronic device can be held in place for example by elastic bands that secure the corners of the electronic device, or the like.

In embodiments, the cover comprises one piece, in that all panels are connected by hinge, seal, sewn seam, spot welds, or the like.

In embodiments, the solar material is flexible, such that hinges are not needed. In embodiments, portions, such as those that rest against an extended side of the electronic device, are stiffened, such as by lamination of an additional layer.

Figure 3:
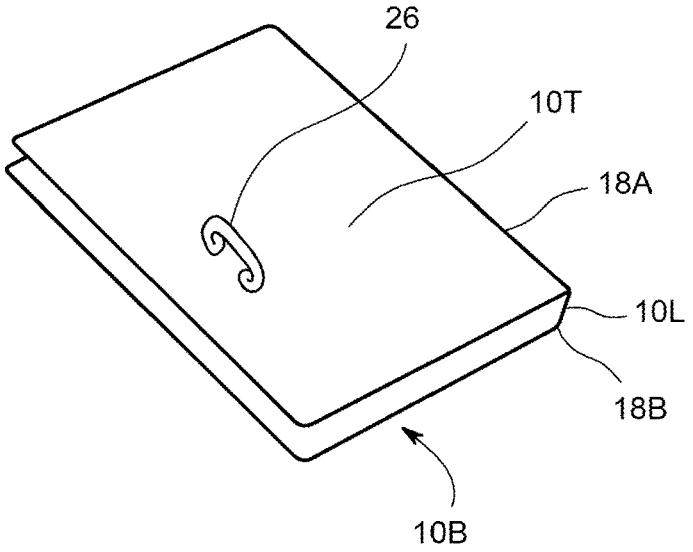
FIG. 3 depicts an illustrative cover as configured for a laptop computer.

FIG. 3 shows an embodiment with two connectors or hinges 18A and 18B, with intervening panel 10L. Handles 26 can be of a durable material such as nylon, including ballistic nylon.

Figure 4:
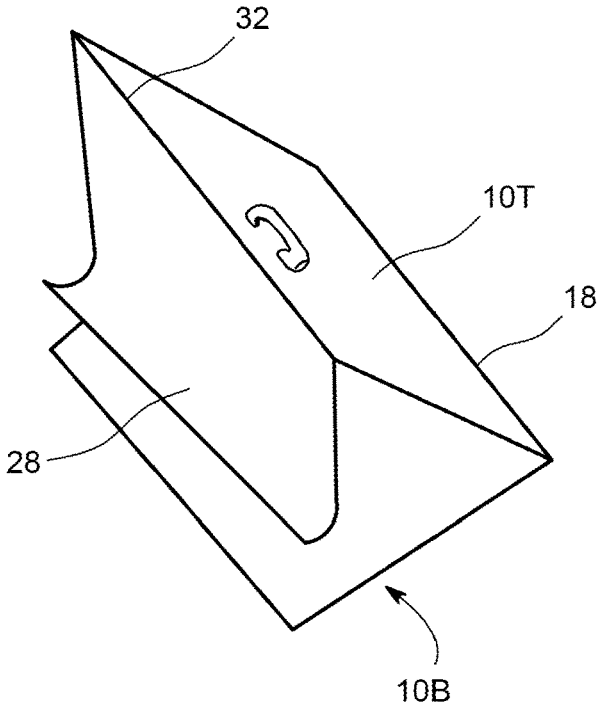
FIG. 4 depicts an illustrative cover with an anti-glare screen protector as configured for a laptop computer.
Figure 5:
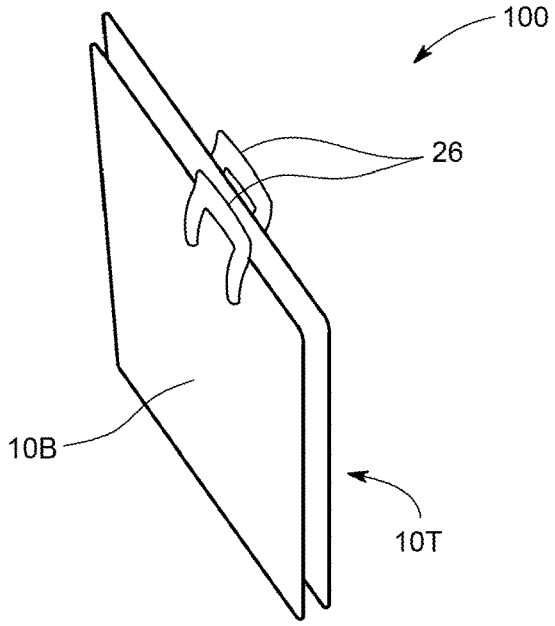
FIG. 5 depicts an illustrative cover as configured for a laptop computer.

FIG. 4 shows an embodiment where a anti-glare screen protector 28 is attached to the rest of the cover 100 by connector or hinge 32. The anti-glare screen protector 28 can be folded behind screen 84 when not needed, or placed in front of screen 84 when needed. FIG. 5 shows a folded view of a cover according to the invention.

The "solar material" is a material with a metalized exterior and an interior with insulating air space formed in plastic. It can for example be a foam or air pockets formed by sealing one layer of plastic to another leaving air pockets. The metallization can be aluminum. The aluminum can be sealed to for example a layer of polyethylene. Material providing air space can for example be laminated onto a metalized layer. Alternatively, the metallization can be on the air-pocket-providing material. An exemplary material is Reflectix, available from Reflectix, Inc. (Markleville, Ind.). The metalized layer is configured to intercept and reflect electromagnetic radiation that generates heat.

Figure 6:
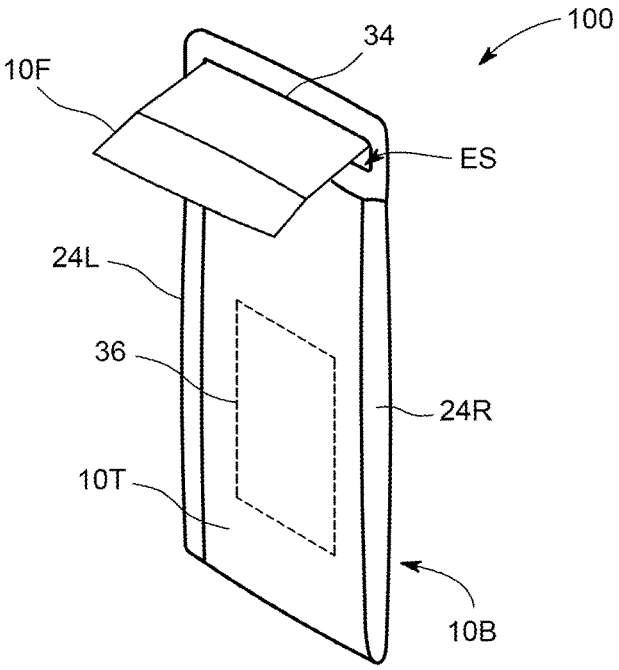
FIGS. 6 and 8 depict an illustrative cover as configured for a cellphone or electronic tablet.

FIG. 6 shows a portable electronic device cover 100 configured for use with a cellphone (e.g., smartphone) or tablet. Panel or flap 10F (connected for example by fold 34) is used to enclose the electronic device within the cover. Sides 24R and 24L can incorporate button extenders that mechanically connect to the buttons on the side of the electronic device to activate them, as is known in the art. Covers 100 (in this or any other embodiment) can be configured for a given electron device. Panel 10T can incorporate a window 36, which can be sized to show substantially all of the display screen of the electronic device, or a selected portion showing important notices.

Window 36 can be covered by a transparent material. In one embodiment, window 36 is has a patterned metal coating such that it appears reflective, but nonetheless the underlying screen can be read when it activates and lights up (in embodiments, with brightness set at a relatively high value). For example, the transparent window material can be sputter coated with a metalizing composition, such as by vapor deposition of metal. In this fashion, the metalized window, while perhaps not as protective as the solar material, reflects solar electromagnetic radiation. In embodiments, the level of metallization can be reduced over the level found in a typical one-way mirror, such that some solar electromagnetic radiation is reflected, but any interference in visualizing of the screen is reduced.

Figure 7:
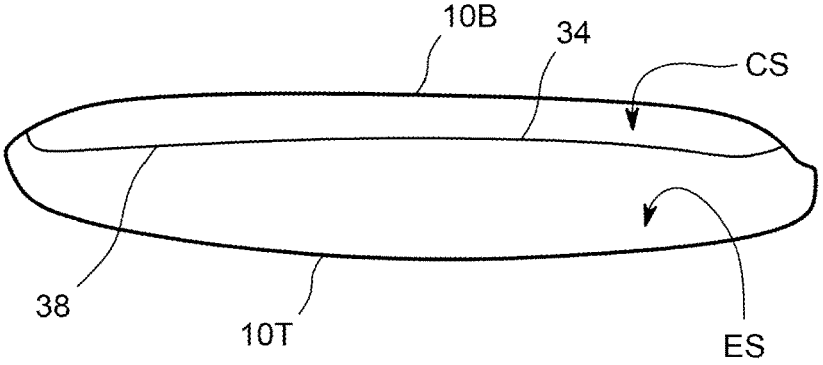
FIG. 7 shows a cross-section of an illustrative cover as configured for a cellphone or electronic tablet.

FIG. 7 shows a top view (in the absence of Panel 10F) of an embodiment where internal panel 38 (e.g., vinyl, ballistic nylon, or the like) forms an internal sleeve CS, for use for example with credits cards or IDs. These items are therefore also protected from heat damage.

Figure 8:
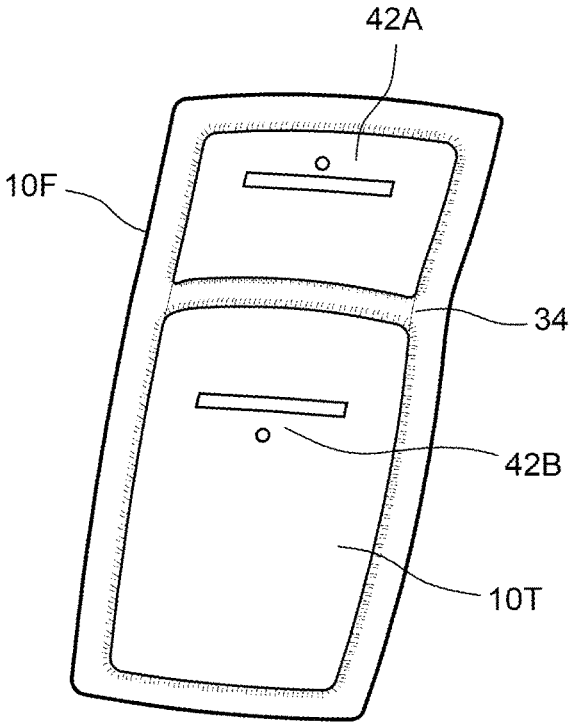

FIG. 8 shows an embodiment with connectors 42A and complementary connectors 42B. The illustration shows a redundant connector such as a button slot, snap, or the like (dot) and a loop or hook (e.g. Velcro) connector (rectangle). Of course, there can be one connector 42A, and its complement 42B.

Where the cover 100 has a substantial window, advice can be provided with the cover to inform the user to orient the device when not in use such that solar material is positioned between the electronic device and a source of substantial heat or infrared energy.

Specific embodiments according to the methods of the present invention will now be described in the following examples. The examples are illustrative only, and are not intended to limit the remainder of the disclosure in any way.

All ranges recited herein include ranges therebetween, and can be inclusive or exclusive of the endpoints. Optional included ranges are from integer values therebetween (or inclusive of one original endpoint), at the order of magnitude recited or the next smaller order of magnitude. For example, if the lower range value is 0.2, optional included endpoints can be 0.3, 0.4, . . . 1.1, 1.2, and the like, as well as 1, 2, 3 and the like; if the higher range is 8, optional included endpoints can be 7, 6, and the like, as well as 7.9, 7.8, and the like. One-sided boundaries, such as 3 or more, similarly include consistent boundaries (or ranges) starting at integer values at the recited order of magnitude or one lower. For example, 3 or more includes 4 or more, or 3.1 or more.

A laminate is a bonding, fusing, adhesion, or the like between polymer layers, or between polymer and fabric layers, such that in the range of anticipated use the laminate is a unitary structure.

Where a sentence states that its subject is found in embodiments, or in certain embodiments, or in the like, it is applicable to any embodiment in which the subject matter can be logically applied.

This invention described herein is of a portable electronic device cover and methods of forming or using the same. Although some embodiments have been discussed above, other implementations and applications are also within the scope of the following claims. Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the following claims.

Publications and references, including but not limited to patents and patent applications, cited in this specification are herein incorporated by reference in their entirety in the entire portion cited as if each individual publication or reference were specifically and individually indicated to be incorporated by reference herein as being fully set forth. Any patent application to which this application claims priority is also incorporated by reference herein in the manner described above for publications and references.

What is claimed is:

1. A cover for a portable electronic device comprising:

an exterior cover having at least one flexible connector and configured to enclose the portable electronic device and to conform to its exterior shape, the cover having an open configuration and a closed configuration;

wherein the cover having solar protective portions of flexible material configured to protect the device from solar injury that comprises an exterior metalized surface laminated to or integral with a foamed or bubbled interior layer, wherein the solar protective portions are located to protect the electronic device from solar heat, wherein the cover is configured for a cell phone or tablet and defining a sleeve with the solar protective portions defining a front portion, a back portion, lateral sides and a bottom side of the cover, wherein the lateral sides and the bottom are defined by a meeting of the front and back portions or by a strip of the solar protective material, and wherein the cover is configured such that a bulk of the electronic device snugly fits into the sleeve, wherein said at least one flexible connector is configured so that the cover can be reversibly folded at a top of the cover to enclose the portable electronic device fitted in the sleeve.

2. The cover of claim 1, wherein the cover comprises a transparent window configured to allow a user to read notices on the cell phone or tablet while the same is enclosed by the cover.

3. The cover of claim 2, wherein the transparent window is partially metalized such that it appears reflective when an underlying screen is not activated, but can be seen through such that the screen can be read when the screen is activated.

4. The cover of claim 1, further comprising a divider defining a second sleeve parallel to the first, wherein the second sleeve is configured to allow one or more IDs or credit cards to be slipped in such that these are protected from solar heat or radiation.

5. A method of protecting a portable electronic device from solar heat or radiation comprising:

providing a cover enclosing the portable electronic device and conforming to its exterior shape comprising:

an exterior cover having at least one flexible connector and configured to enclose the electronic device, the cover having an open configuration and a closed configuration; wherein the cover having solar protective portions of flexible material configured to protect the device from solar injury that comprises an exterior metalized surface laminated to or integral with a foamed or bubbled interior layer, wherein the solar protective portions are located to protect the electronic device from solar heat, and wherein the cover is configured for a cell phone or tablet and defining a sleeve with the solar protective portions defining a front portion, a back portion, lateral sides and a bottom side of the cover, wherein the lateral sides and the bottom are defined by a meeting of the front and back portions or by a strip of the solar protective material, and wherein the cover is configured such that a bulk of the electronic device snugly fits into the sleeve, wherein a said flexible connector is configured so that the cover can be reversibly folded at a top of the cover to enclose the electronic device fitted in the sleeve.

6. The method of claim 5, wherein the provided cover comprises a transparent window configured to allow a user to read notices on the cell phone or tablet while the same is enclosed by the method.

7. The method of claim 5, wherein the cover further comprises a divider defining a second sleeve parallel to the sleeve, wherein the second sleeve is configured to slidably accept one or more IDs or credit cards such that these are protected from solar heat or radiation.

* * * * *